United States Patent [19]

Ong et al.

[11] Patent Number: 5,013,630

[45] Date of Patent: May 7, 1991

[54] ENCAPSULATED TONER COMPOSITIONS

[75] Inventors: Beng S. Ong, Mississauga; Grazyna Kmiecik-Lawrynowicz, Burlington; Fernando Yulo, Mississauga; Kayong Koch, Scarborough, all of Canada

[73] Assignee: Xerox Corporation, Stamford, Conn.

[21] Appl. No.: 395,677

[22] Filed: Aug. 18, 1989

[51] Int. Cl.[5] ..... G03C 1/72; G03G 9/00

[52] U.S. Cl. ..... 430/138; 430/109

[58] Field of Search ..... 430/138, 109

[56] References Cited

U.S. PATENT DOCUMENTS

| | | | |
|---|---|---|---|
| 3,974,078 | 8/1976 | Crystal | 430/109 |
| 4,766,051 | 8/1988 | Breton et al. | 430/138 |
| 4,814,253 | 3/1989 | Gruber et al. | 430/138 X |
| 4,851,318 | 7/1989 | Hsieh et al. | 430/137 |

FOREIGN PATENT DOCUMENTS

| | | | |
|---|---|---|---|
| 0254049 | 12/1985 | Japan | 430/138 |
| 1055647 | 3/1986 | Japan | 430/138 |
| 1056352 | 3/1986 | Japan | 430/138 |

*Primary Examiner*—Marion E. McCamish
*Assistant Examiner*—S. Crossan
*Attorney, Agent, or Firm*—E. O. Palazzo

[57] ABSTRACT

An encapsulated toner composition comprised of a core comprised of pigments or dyes, and a polysiloxane-incorporated core binder resin, which core is encapsulated in a shell.

42 Claims, No Drawings

ENCAPSULATED TONER COMPOSITIONS

BACKGROUND OF THE INVENTION

The present invention is generally directed to toner compositions, and more specifically to encapsulated toner compositions. In one embodiment, the present invention is related to encapsulated toner compositions comprised of a pressure-rupturable polymeric shell, and a core containing colorants and a polymer binder with a polysiloxane-incorporated material therein. The toner shell is preferably prepared by interfacial polymerization while the core binder is preferably obtained by addition polymerization. Another specific embodiment of the present invention relates to encapsulated toner compositions comprised of a core containing certain polysiloxane-incorporated polymer binders, and dye or pigment particles, which core is encapsulated by a polymeric shell coating such as a polyurea, a polyurethane, a polyester, a polyamide, mixtures thereof, and the like, including other know suitable shells. Advantages associated with the toner compositions of the present invention include the elimination and/or the minimization of image ghosting, excellent toner fixing characteristics, superior surface release properties enabling their selection, for example, in imaging systems wherein a release fluid such as a silicone oil is avoided, substantially no blocking or agglomeration of toner particles, acceptable toner powder flow characteristics, minimal or no leaching of core components, simplicity in toner preparation, and low manufacturing cost. The toner compositions of the present invention can be selected for a variety of known reprographic imaging processes including electrophotographic and ion printing (ionography) processes. Specifically, the toner compositions of the present invention can be selected for commercial Delphax printers such as the Delphax S9000, S6000, S4500, S3000, Xerox Corporation 4060 TM, 4075 TM and the like. They can also be utilized in electrophotographic copying and printing apparatus wherein the transfer of developed images onto paper is electrostatically accomplished, and the subsequent fixing of transferred images is accomplished by application of pressure, thermal energy or a combination of pressure and thermal energy. The toner compositions of the present invention provide excellent surface release characteristics, and the use of lubricating silicone oils or other surface release fluids to prevent image offset to, for example, the pressure roll and hot roll fuser can be avoided in most embodiments.

The toner compositions of the present invention can in one specific embodiment be prepared by first mechanically dispersing a mixture of colorants, reactive monomers, polymerization initiators, and functionalized polysiloxanes into microdroplets of specific size and size distribution in an aqueous medium containing an emulsifier or stabilizer. The reactive monomers in the resulting organic phase include one or more polyfunctional monomers for shell formation, and one or more addition-type core monomers. The polymerization initiators are typically free-radical initiators. The shell formation around the microdroplets can then be initiated by adding a second polyfunctional shell monomer which is water miscible into the reaction medium. Polycondensation occurs between the two polyfunctional shell forming monomers at the water-microdroplet interface resulting in the formation of a microcapsule shell around a microdroplet. Thereafter, the formation of the core binder polymer from the core monomer within the newly formed microcapsules can be initiated by thermal energy. Thus, one embodiment of the present invention is directed to a process for the simple, and economical preparation of pressure fixable encapsulated toner compositions by a method involving a shell-forming interfacial polycondensation and an in situ core binder synthesis by free-radical polymerization wherein there are selected at least two polymerizable core precursors one of which is a suitably functionalized polysiloxane polymer, preferably an acryloxy-functionalized, a methacryloxy-functionalized, other vinyl-functionalized polysiloxane polymer, and the like. Other process embodiments of the present invention relate to, for example, interfacial/free-radical polymerization processes for obtaining encapsulated colored toner compositions. Further, in another process aspect of the present invention, the encapsulated toners can be prepared without or with a minimum amount of organic solvents, thus eliminating or minimizing explosion hazards associated therewith; and furthermore, the solvent-free processes of the present invention therefore do not require expensive and hazardous solvent separation and recovery steps. Moreover, with the aforementioned process of the present invention there are obtained improved throughput yields of toner product per unit volume of reactor size since, for example, the extraneous solvent component can be replaced by usable liquid core monomer(s). The aforementioned toners prepared in accordance with the process of the present invention can be selected, for example, as indicated herein for permitting the development of images in reprographic systems, inclusive of electrophotographic and ionographic imaging processes wherein pressure fixing is selected. Further, the encapsulated toners of the present invention are suitable for use either in known two-component development process wherein the toners are utilized together with carrier particles, or in single-component development process wherein only the toner materials are involved.

In ion printing processes, such as the commercially used Delphax ionographic printing processes, electrostatic images are generated on a dielectric receiver surface with an ion depositing head; the images are then developed with a conductive magnetic toner, and thereafter simultaneously transferred and fixed in one single step (referred to as transfix) onto a substrate such as paper with an applied pressure. The transfix pressure can range from very low, that is for example from less than 1,000 psi to as high as 6,000 psi, provided the printing objectives are achieved and that no objectionable physical damages to the paper substrate result. One of the common problems encountered with the print quality of ionography is image ghosting. This print drawback refers to the unwarranted repetitious printing of images on paper, and arises primarily from the contamination of the dielectric receiver surface by some of the toner material. Other disadvantages associated with the use of known conventional toners usually include poor image resolution primarily because of large toner particle size, low image fix, low image smear resistance, the requirement of high transfix pressure which leads to paper calendering, high image gloss characteristics and poor image background.

Encapsulated and pressure fixable toner compositions are known. Pressure fixable toners have a number of advantages in comparison to toners that are fused by heat, primarily relating to the utilization of less energy since the toner compositions used can be fixed without the application of heat. Nevertheless, many of the prior art pressure fixable toner compositions suffer from a number of deficiencies. For example, these toner compositions generally have low fixing characteristics and must usually be fixed under an extremely high pressure, which causes the undesirable paper calendering and high image gloss characteristics. Low image resolution can also result. Further, with some of the prior art pressure fixable toner compositions, substantial image smearing can result from the high pressures used. The images generated by the prior art toners often can be readily rubbed off with pressure or removed by folding. The involvement of large quantity of solvents in the prior art processes also renders the product yield per unit volume of reactor size low; and further, the separation and recovery of solvents is usually a very costly endeavor. More importantly, with many of the prior art processes, toner particles of narrow size distribution cannot be easily achieved by conventional bulk homogenization techniques because of the high viscosity of the organic phase as contrasted with the process of the present invention where toners of narrow particle size distribution can be obtained. In addition, many prior art processes provide deleterious effects on toner particle morphology and bulk density as a result of the removal of solvent and the subsequent collapse of toner particles during particle isolation resulting in a toner of very low bulk density, which disadvantages are substantially eliminated with the process of the present invention. More specifically, thus with the encapsulated toners of the present invention control of the toner physical properties of both the core and shell materials can be readily achieved. Specifically, with the encapsulated toners of the present invention undesirable leaching or loss of core components is avoided or minimized, and image ghosting is eliminated in many instances primarily because of the presence of the polysiloxane-incorporated core binder resin component, which binder structure may also have incorporated therein a low crosslink density through the stoichiometry and functionality of the polysiloxane polymer utilized. In addition, the encapsulated toners of the present invention possess excellent powder flow properties, and do not aggregate, agglomerate or block in storage or when used in copying or printing machines. For printing in an ionographic printer such as the commercial Delphax S3000, S4500, S6000 or S9000 printer, the encapsulated toner compositions of the present invention enable the generation of high fix quality prints without image ghosting. For xerographic copying or printing where the image transfer and fixing are generally two separate processes, the toner compositions of the present invention facilitate ready image transfer from photoreceptor to paper, and enables cold pressure fixability without the problem of image offset onto the pressure roller surface, often without having to use surface release lubricating fluids such as silicone oils. The encapsulated toner compositions of the present invention also enable pressure fixability with significantly lower pressures thus the common problems of paper calendering or undesirable glossy images related to pressure fixing are substantially suppressed or eliminated.

There were reported in a patentabilty search letter the following prior art U.S. Pat. No. 4,770,968, which discloses styrene butadiene terpolymers of the formula as illustrated in the Abstract, which polymers can be selected as toner resins, reference column 4, however, this patent does not disclose encapsulated toners; U.S. Pat. No. 4,814,253 discloses an encapsulated toner comprised of domains containing a polymer component having dispersed therein a release composition and thereover a host resin component comprised of toner resin particles and pigment particles, see for example columns 1 and 2, and working Example 1, column 7; U.S. Pat. No. 4,740,443 discloses an encapsulated toner which is comprised of a core containing a colorant and soft solid material, inorganic fine particles attached to the vicinity of the surface and a shell coating wherein inorganic fine particles reinforce the encapsulated toner with a thin shell, see the Abstract of the Disclosure, and also note columns 4, 5 and 6; U.S. Pat. No. 4,642,281 directed to encapsulated toner compositions which may include as additional core materials polymers including polyolefins such as silicon resins, see column 11; U.S. Pat. Nos. 3,965,022 and 4,142,982.

With further specific reference to the prior art, there are illustrated in U.S. Pat. No. 4,307,169, the disclosure of which is totally incorporated herein by reference, encapsulated electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there are disclosed in U.S. Pat. No. 4,407,922 pressure sensitive toner compositions comprised of a blend of two immiscible polymers selected from the group consisting of certain polymers as a hard component, and polyoctyldecylvinylether-comaleic anhydride as a soft component. Interfacial polymerization process can be selected for the preparation of the toners of this patent. Also, there are disclosed in the prior art encapsulated toner compositions containing costly pigments and dyes, reference for example the color photocapsule toners of U.S. Pat. Nos. 4,399,209; 4,482,624; 4,483,912 and 4,397,483. In U.S. Pat. No. 4,803,144, there are disclosed microcapsule toners obtained by interfacial polymerization microencapsulation process wherein a preformed polymer is employed as the core binder. The process of this invention also illustrates the use of a suitable low boiling solvent to dissolve the polymer binder, and to promote the interfacial polymerization process.

Moreover, illustrated in a U.S. Pat. No. 4,758,506, the disclosure of which is totally incorporated herein by reference, are single component cold pressure fixable toner compositions, wherein the shell selected can be prepared by an interfacial polymerization process. A similar teaching is present in copending application U.S. Ser. No. 718,676, (now abandoned) the disclosure of which is totally incorporated herein by reference. In the aforementioned application, the core can be comprised of magnetite and a polyisobutylene of a specific molecular weight encapsulated in a polymeric shell material generated by an interfacial polymerization process.

Liquid developer compositions are also known, reference for example U.S. Pat. No. 3,806,354, the disclosure of which is totally incorporated herein by reference. This patent illustrates liquid inks comprised of one or more liquid vehicles, colorants such as pigments, and dyes, dispersants, and viscosity control additives. Examples of vehicles disclosed in the aforementioned patent are mineral oils, mineral spirits, and kerosene; while examples of colorants include carbon black, oil red, and oil blue. Dispersants described in this patent include materials such as polyvinyl pyrrolidone. Additionally, there is described in U.S. Pat. No. 4,476,210, the disclosure of which is totally incorporated herein by reference, liquid developers containing an insulating liquid dispersion medium with marking particles therein, which particles are comprised of a thermoplastic resin core substantially insoluble in the dispersion, an amphipathic block or graft copolymeric stabilizer irreversibly chemically or physically anchored to the thermoplastic resin core, and a colored dye imbibed in the thermoplastic resin core. The history and evolution of liquid developers is provided in the '210 patent, reference columns 1 and 2 thereof.

Free-radical polymerization is well known art, and can be executed in bulk, solution, or suspension polymerization. Both bulk and solution free-radical polymerization are commonly employed as in situ processes for the generation of core binder materials from the corresponding monomers within the toner microcapsules. With solution polymerization, core monomer is dissolved in a suitable solvent such as methylene chloride, while in bulk polymerization, only core monomer is employed, and the polymerization is effected in the absence of solvent.

Accordingly, there is a need for encapsulated toner compositions with the advantages illustrated herein. More specifically, there is a need for encapsulated toners wherein image ghosting is eliminated or minimized. Also, there is a need for encapsulated toners wherein images with excellent resolution and superior fix are obtained. Moreover, there is a need for encapsulated toners, including colored toners wherein ghosting, toner offsetting, undesirable leaching of core components and the like are avoided or minimized. Additionally, there is a need for encapsulated toners, including colored toners with excellent release characteristics enabling their selection in imaging systems with no silicone oils and the costly apparatus associated therewith. Furthermore, there is a need for encapsulated toners, including colored toners with substantially no toner agglomeration, aggregation or blocking, and/or long shelf life exceeding, for example, one to two years. Also, there is a need for encapsulated toners with treated surfaces to provide desirable conductivity characteristics suitable for inductive single component development. The aforementioned inductive development processes have the advantages of low development voltage, and very sharp developability which ensures high quality printing with no undesirable image background. Further, there is a need for encapsulated toners wherein surface additives such as metal salts or metal salts of fatty acids and the like can be utilized to assist in the surface release of toner during the fixing or fusing process. Another need resides in the provision of an encapsulated toner composition which can be pressure-fixed at pressures of, for example, 2,000 psi in many embodiments, which pressures are significantly lower than the 4,000 psi that are normally operating in many commercial machines such as the Delphax S6000 and S3000 printers. A further need resides in simple, economical preparative processes for the encapsulated toners. Specifically, there is a need for interfacial/free-radical polymerization processes for black and colored encapsulated toner compositions, wherein the core contains a polysiloxane-incorporated core resin binder comprised of an addition-type monomer or monomers, and a functionalized polysiloxane polymer capable of undergoing free-radical polymerization, a free-radical initiator together with colorants and other materials, and wherein solvents are eliminated in some embodiments. Furthermore, there is a need for improved processes that will enable preparation of pressure fixable encapsulated toner compositions with hard shells and soft cores, whose properties such as molecular weight, molecular weight dispersity and degree of crosslinking can be independently and desirably controlled. Moreover, there is a need for enhanced flexibility in the design and selection of materials comprising the core and shell of encapsulated toner particles, and the control of the toner physical properties, such as bulk density, particle size, and size dispersity of toner. With free-radical core polymerizations, for example, control of bulk physical properties of core binder such as melt viscosity can be obtained, for example, by the selection of appropriate monomer(s), and initiators, and concentrations as well as by the control of reaction temperature profile.

SUMMARY OF THE INVENTION

It is an object of the present invention to provide encapsulated toner compositions with many of the advantages illustrated herein.

In another object of the present invention there are provided encapsulated toner compositions comprised of a core of polysiloxane-incorporated binder resin, (that is for example a polymer containing polysiloxane segments, which core is formed by the addition of polysiloxanes with functional groups as indicated herein to core monomers) and pigments and/or dyes, and wherein the aforementioned core is surrounded or encapsulated by a microcapsule shell prepared, for example, by interfacial polymerization.

A further object of the present invention is to provide pressure-fixable encapsulated toner compositions which offer excellent image quality such as high fix, high resolution, low gloss, smear-resistance, and other desirable toner characteristics.

Another object of the present invention is to provide encapsulated toners wherein image ghosting is eliminated in some embodiments, or minimized in other embodiments.

A further object of the present invention is the provision of encapsulated toners wherein toner aggregation, agglomeration or blocking is eliminated in some embodiments, or minimized in other embodiments.

Also, another object of the present invention is to provide encapsulated toners wherein core component leaching or loss is eliminated in some embodiments, or minimized in other embodiments.

Moreover, another object of the present invention is the provision of encapsulated toners wherein toner offsetting to the pressure roll, fixing or fuser roll is eliminated in some embodiments, or minimized in other embodiments.

Additionally, another object of the present invention is the provision of encapsulated toners with extended shelf life.

Further, another object of the present invention is the provision of encapsulated toners with excellent surface release and powder flow properties.

Also another object of the present invention is the provision of colored, that is other than black, encapsulated toners.

It is another object of the present invention to provide encapsulated toners wherein contamination of the components of the imaging member such as the photoreceptor, a dielectric receiver including electroreceptors, pressure roll, fixing or fuser roll is eliminated or minimized.

Another object of the present invention is the provision of encapsulated toners that can be selected for imaging processes, especially processes wherein cold pressure fixing is selected.

In another object of the present invention there are provided simple and economical processes for black, and colored toner compositions formulated by an interfacial/free-radical polymerization process in which the shell formation (interfacial polymerization), core formation (free-radical polymerization), and the resulting material properties are independently controlled.

Another object of the present invention resides in the provision of simple one-pot and economical processes for manufacturing black, and colored toners of specific particle size and size distribution while avoiding the prior art costly subsequent particle size classification processes.

Moreover, in a further object of the present invention there are provided preparative processes for cold pressure fixable toner compositions wherein solvents are replaced with a free-radical polymerizable liquid monomer or monomers.

These and other objects of the present invention are accomplished by the provision of toners and more specifically encapsulated toners. In one embodiment of the present invention, there are provided encapsulated toners with a core containing a soft polysiloxane-incorporated binder resin and colorants, and a hard polymeric shell thereover. Specifically, in one embodiment there are provided in accordance with the present invention encapsulated toners comprised of a core containing dye or pigment particles, a polymer binder with a polysiloxane-incorporated therein, and preferably obtained by free-radical polymerization, and thereover a microcapsule shell preferably obtained by interfacial polycondensation. In accordance with another embodiment of the present invention, there are provided encapsulated toners wherein the core binders are complex addition polymers obtained from at least two precursors, one of which is a suitably functionalized polysiloxane, which polysiloxane can, for example, serve as an active site for macromolecular branching and crosslinking, and a monomer capable of being copolymerized. The functionalized polysiloxane will undergo copolymerization with the addition-type core monomer, resulting in the formation of polysiloxane-incorporated core binder. Depending on the functionality of the polysiloxane, chain branching and/or crosslinking may occur resulting in the formation of a branched or crosslinked core binder material. The nature and degree of branching and crosslinking are dependent, for example, on the functionality and stoichiometry of the polysiloxane selected.

The aforementioned toners of the present invention can be prepared by a number of different processes including the interfacial/free-radical polymerization process which comprises (1) mixing or blending of a core monomer or monomers, a functionalized polysiloxane, free-radical initiator, pigment, and a shell monomer or monomers; (2) dispersing the resulting mixture of organic materials by high shear blending into stabilized microdroplets in an aqueous medium with the assistance of suitable dispersants or emulsifying agents; (3) thereafter subjecting the aforementioned stabilized microdroplets of, for example, a specific droplet size and size distribution to a shell forming interfacial polycondensation; and (4) subsequently forming the core binder by heat-induced free-radical polymerization within the newly formed microcapsules. The shell forming interfacial polycondensation is generally accomplished at ambient temperature, but elevated temperatures may also be employed depending on the nature and functionality of the shell monomer selected. The core binder forming free-radical polymerization can generally be effected at a temperature of from ambient temperature to about 100° C., and preferably from ambient temperature to about 85° C. In addition, more than one initiator may be utilized to enhance the polymerization conversion, and to generate the desired molecular weight and molecular weight distribution for the core polymer or polymers.

Further, in accordance with the present invention there are provided preparative processes for black and colored pressure fixable toner compositions which are obtained without the use of an organic solvent. These processes involve dispersing a mixture of organic materials and colorants to form stabilized microdroplets in an aqueous medium containing a dispersant or emulsifying agent. The resulting organic mixture is comprised of, for example, from about 20 to about 50 percent by weight of a core monomer, about 0.5 to 20 percent of a suitably functionalized polysiloxane, about 5 to 65 percent of a colorant or colorants, about 1 to 30 percent of a shell forming monomer component, and a free-radical initiator. The shell formation around the dispersed, stabilized microdroplets via interfacial polycondensation is initiated by adding another shell forming, water-miscible monomer component into the aqueous phase. Subsequently, the reaction mixture is subjected to heating to initiate free-radical polymerization of core monomer to form core binders within the newly formed microcapsules.

Examples of core monomers present in effective amounts of, for example, from about 5 to about 90 weight percent selected include, but are not limited to, addition-type monomers such as acrylates and methacrylates, including propyl acrylate, propyl methacrylate, butyl acrylate, butyl methacrylate, hexyl acrylate, pentyl acrylate, pentyl methacrylate, hexyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, heptyl acrylate, heptyl methacrylate, isobutyl acrylate, isobutyl methacrylate, methylbutyl acrylate, methylbutyl methacrylate, tolyl acrylate, tolyl methacrylate, and the like; styrene, dodecyl styrene, hexyl methyl styrene, nonyl styrene, tetradecyl styrene, or other substantially equivalent addition monomers; and mixtures thereof. Suitable functionalized polysiloxanes that can be selected for incorporation into the core binder structure include any appropriate polysiloxanes capable of undergoing addition polymerization provided they can copolymerize with the core monomers to afford the polysiloxaneincorporated core binder resins. The functionalized polysiloxane can be employed in an effective amount of, for example, from about 0.5 percent to about 35 percent by weight of the resultant core binder, and preferably from about 2 percent to about 15 percent by weight of the resultant core binder.

Illustrative examples of suitable polysiloxanes include acryloxy-functionalized, methacryloxy-functionalized, styryl-functionalized polysiloxanes, and the like. The polysiloxanes selected can be polyfunctional, that is they may contain more than one polymerizable functionality to provide a desired crosslinked structure into the core binder system. Thus, in one specific embodiment, acryloxy-terminated and methacryloxy-terminated polysiloxanes are employed to synthesize nonlinear, crosslinked polysiloxane-incorporated core binder resins for the encapsulated toner compositions of the present invention. The advantage of a nonlinear binder structure relates to the enhanced binder molecular size permitting the elimination or substantial suppression of the binder leaching process, which binder leaching would cause undesirable toner agglomeration and blocking problems.

Specific examples of functionalized polysiloxanes that can be selected for incorporation into the core polymer binder include, but are not limited to, polysiloxanes of the following Formulas (I) through (VI). The polysiloxanes are generally selected in an effective amount of preferably, for example, from about 2 percent to about 15 percent by weight of the resultant core binder.

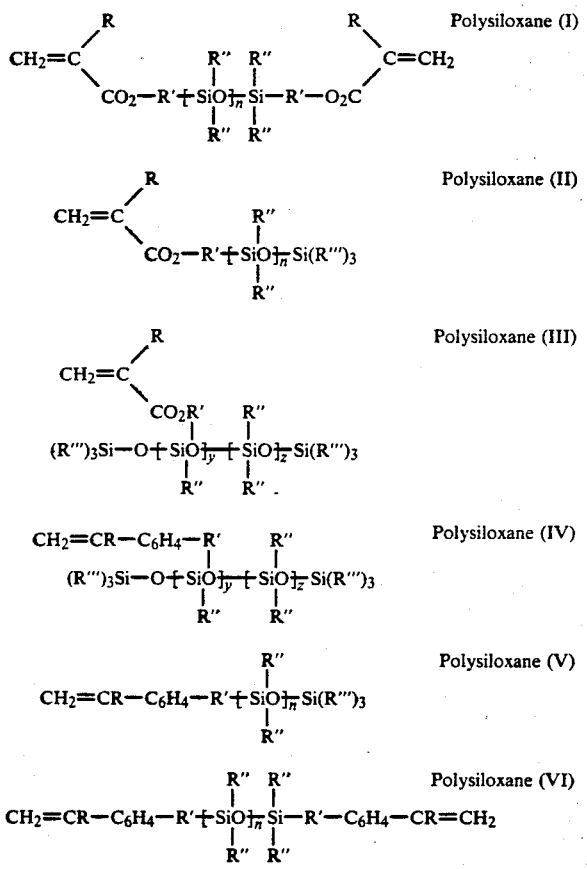

where R′ is independently selected from alkylene, arylene, the substituted derivatives thereof, and the like containing, for example, from 1 to about 20 carbon atoms, and preferably from 1 to about 5 carbon atoms; R,R″ and R‴ are independently selected from alkyl groups containing, for example, from 1 to about 20 carbon atoms, and preferably a methyl or ethyl group; n is the number of dialkylsiloxy ($—R''_2SiO—$) units, such as from about 10 to about 2,000; and y and z are the mole fraction numbers of functionalized siloxy units and dialkylsiloxy units respectively, wherein y is greater than 0, and the sum of y+z is equal to 1.0.

Illustrative examples of R′ include methylene, dimethylene, trimethylene, tetramethylene, pentamethylene, hexamethylene, and arylene with, for example, from 6 to about 24 carbon atoms such as phenylene, tolylene, bis(1,4-phenylene)methane, and the like; illustrative examples of alkyl groups, R,R″ and R‴ examples include methyl, ethyl, propyl, butyl, 2-methylbutyl, pentyl, 3-methylpentyl, hexyl, heptyl, octyl, and the like.

Illustrative examples of free-radical initiators selected for the preparation of the toners of the present invention include azo compounds such as 2—2′azodimethylvaleronitrile, 2—2′azoisobutyronitrile, azobiscyclohexanenitrile, 2-methylbutyronitrile or any combination of these azo compounds with the quantity of initiator(s) being, for example, from about 0.5 percent to about 10 percent by weight of that of core monomer(s).

Suitable colorants for the encapsulated toner compositions of the present invention include various known pigments, dyes, or mixtures thereof in some instances present in the core in an effective amount of, for example, from about 2 to about 65 percent by weight. Illustrative examples of selected colorants are carbon black, magnetites, such as Bayer's Bayferrox 8600, 8610; Northern Pigments' NP-608, NP-604; Magnox's TMB-100, TBM-104; Mobay's MO8029, MO8060; Columbian Pigments; Mapico Blacks and other surface treated magnetites; Pfizer's CB4799, CB5300, CB5600, MCX6241, MCX6368, and other equivalent black pigments. Generally, colored pigments that can be selected include red, blue, brown, green, cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4′-chloro-2,5-dimethoxy acetoacetanilide, and Permanent Yellow FGL. Other illustrative colored pigments include Heliogen Blue L6900, D6840, D7080, D7020, Pylam Oil Blue and Pylam Oil Yellow, Pigment Blue 1 available from Paul Uhlich & Company Inc., Pigment Violet 1, Pigment Red 48, Lemon Chrome Yellow DCC 1026, E.D. Toluidine Red and Bon Red C available from Dominion Color Corporation Ltd., Toronto, Ontario, NOVAperm Yellow FGL, Hostaperm Pink E from Hoechst, Cinquasia Magenta available from E.I. DuPont de Nemours & Company, and Oil Red 2144 from Passaic Color and Chemical. The aforementioned pigments are incorporated into the microcapsule toner compositions in various suitable effective amounts. In one embodiment, these colored pigment particles are present in the toner composition in an amount of from about 2 percent by weight to about 75 percent by weight calculated on the weight of the dry toner. Colored magnetites, such as mixtures of Mapico Black, and cyan components may also be selected as pigments for the toner compositions of the present invention.

Examples of shell polymers include polyureas, polyamides, polyesters, polyurethanes, mixtures thereof, and the like. The shell content is generally from 5 to 30 percent by weight of the toner composition, and the shell usually has a thickness generally, for example, of less than about 5 microns, and more specifically from about 0.1 to about 3 microns. Other shell polymers, shell contents, and thicknesses may be selected providing, for example, that some of the objectives of the present invention are achievable.

The shell forming monomer components present in the organic phase comprised of the core monomers, functionalized polysiloxane, and colorants are generally comprised of diisocyanates, diacyl chloride, bischloroformate, together with appropriate polyfunctional crosslinking agents such as triisocyanate, triacyl chloride and other polyisocyanates. Illustrative examples of the aforementioned monomer components include benzene diisocyanate, toluene diisocyanate, diphenylmethane diisocyanate, cyclohexane diisocyanate, hexane diisocyanate, adipoyl chloride, fumaryl chloride, suberoyl chloride, succinyl, chloride, phthaloyl chloride, isophthaloyl chloride, terephthaloyl chloride, ethylene glycol bischloroformate, diethylene glycol bischloroformate. The water soluble, shell forming monomer components in the aqueous phase can be a polyamine or a polyol including bisphenols, the nature of which is dependent on the desired shell materials for the desired applications. Illustrative examples of water soluble shell monomers include ethylenediamine, triethylenediamine, diaminotoluene, diaminopyridine, bis(aminopropyl)piperazine, bisphenol A, bisphenol Z, and the like. When desired, a water soluble crosslinking agent such as triamine or triol can also be added to improve the mechanical strength of shell structure. Shell examples are detailed in U.S. Pat. No. 4,855,209, entitled Process for Controlling the Electrical Characteristics of Toners, the disclosure of which is totally incorporated herein by reference.

In one specific embodiment of the present invention, there is provided an improved process for the preparation of improved encapsulated toner compositions, which process comprises mixing and dispersing a core monomer, a functionalized polysiloxane, a free-radical initiator, pigment particles or dyes, and a shell monomer into microdroplets of specific droplet size and size distribution in an aqueous medium containing a dispersant or stabilizer; the volume average microdroplet diameter generally ranges from about 5 microns to about 30 microns, and the volume average droplet size dispersity ranges from about 1.2 to about 1.4 as determined by Coulter Counter measurements of the microcapsule particles after encapsulation; forming a microcapsule shell around the microdroplets via interfacial polymerization by adding a water soluble shell forming monomer component; and subsequently affecting a free-radical polymerization to form a core binder resin within the newly formed microcapsules by, for example, heating the reaction mixture from room temperature to about 100° C. for a period of from about 1 to about 10 hours. Stabilizers selected for the process of the present invention include polymeric water soluble high molecular weight polymers such as poly(vinyl alcohols), methyl cellulose, hydroxypropylcellulose and the like. For the toners of the present invention, the average volume microdiameter generally is from, for example, about 5 microns to about 30 microns, and the average volume droplet size dispersity generally is from about 1.2 to about 1.4 as inferred from Coulter Counter measurements of the capsule particles after encapsulation.

Interfacial polymerization processes selected for shell formation for the toners of the present invention are as illustrated, for example, in U.S. Pat. Nos. 4,000,087 and 4,307,169, the disclosures of which are totally incorporated herein by reference.

Surface additives can be selected for toners of the present invention including, for example, metal salts, metal salts of fatty acids, colloidal silicas, mixtures thereof and the like, which additives are usually present in an amount of from about 0.1 to about 3 weight percent, reference U.S. Pat. Nos. 3,590,000; 3,720,617; 3,655,374 and 3,983,045 the disclosures of which are totally incorporated herein by reference. Preferred additives include zinc stearate and Aerosil.

Also, the toner compositions of the present invention can be rendered relatively conductive with, for example, a volume resistivity of from about $5\times10^4$ ohm-cm to about $5\times10^6$ ohm-cm by adding to the surface thereof components such as carbon blacks, graphite, and other conductive materials in an effective amount ranging from about 0.1 percent to about 8 percent by weight of toner, and preferably from about 1 percent to about 6.5 percent by weight of toner. The conductive toner surface enables the use of inductive development systems such as those in the commercial Delphax printer machines.

Known carrier components can be selected for the two component developers of the present invention, including iron, ferrites, steel, and the like, with or without a coating, reference for example U.S. Pat. Nos. 4,937,166 and 4,935,326, the disclosures of which are totally incorporated herein by reference.

The following examples are being submitted to further define various species of the present invention. These examples are intended to be illustrative only and are not intended to limit the scope of the present invention.

EXAMPLE I

A 16.9 micron diameter conductive black encapsulated toner comprising a crosslinked polysiloxane-incorporated poly(lauryl methacrylate) core binder was prepared as follows.

A mixture of 120 grams of lauryl methacrylate (available as Rocryl 320 from Rohm and Haas), 13.0 grams of methacryloxypropyl terminated polydimethylsiloxane (the polysiloxane encompassed by Formula (I)) with a viscosity of from about 1,500 to about 2,500 centistokes, 3.30 grams each of 2,2'-azobis-(2,4-dimethylvaleronitrile) and 2,2'-azobis-(isobutyronitrile), and a solution of 47.1 grams of Isonate 143 L in 20 milliliters of dichloromethane was mixed in a 2-liter Nalgene container with a Brinkmann polytron equipped with a PT 35/4 probe at 4,000 RPM for 30 seconds. Two hundred and eighty (280) grams of Northern Pigments magnetite NP-608 was then added, and the resulting mixture was homogenized by high sheer blending using the same Brinkmann polytron at 8,000 RPM for 3 minutes. To the mixture was then added 1 liter, 0.18 percent (by weight), aqueous poly(vinyl alcohol) (88 percent hydrolyzed; MW, molecular weight average of 96,000) solution, and thereafter, the mixture was blended at 9,000 RPM with an IKA polytron equipped with a T45/4G probe for 2 minutes. A solution of 37 milliliters of 1,4-bis (3-aminopropyl)piperazine in 80 milliliters of water was then added with constant stirring for 10 minutes to initiate the microcapsule shell forming reaction. Subsequently, the mixture was transferred to a 3-liter reaction kettle and was mechanically stirred at room temperature for approximately 1 hour to complete the shell forming polycondensation reaction. Thereafter, the mixture was heated in an oil bath to initiate the core binder-forming free radical polymerization. The temperature of the mixture was gradually raised from room temperature to a final temperature of 85° C. over a period of 1 hour. Heating was continued at this temperature for an additional 6 hours before the mixture was cooled down to room temperature. After the reaction, the microcapsule toner product was transferred to a 4-liter beaker, and washed repeatedly with water until the washing was clear, and the toner product resulting was then sieved through a 180 micron sieve to remove coarse material. The wet toner was transferred to a 2-liter beaker and was diluted with water to a total volume of 1.8 liter. 23.5 grams of colloidal graphite, Aquadag E from Acheson Colloids, diluted with 100 milliliters of water, was added to the beaker, and the mixture was spray dried in a Yamato Spray Dryer at an air inlet temperature of 160° C., and an air outlet temperature of 80° C. The air flow was retained at 0.75 meters$^3$/minute, while the atomizing air pressure was kept at 1.0 killigrams/cm$^2$. The collected encapsulated dry toner (360 grams) was screened through a 63 micron sieve; the toner's volume average particle diameter, as measured on a 256 channel Coulter, was 16.9 microns with a volume average particle size dispersity of 1.27.

Two hundred and forty (240) grams of the above toner was dry blended using a Greey blender, first with 0.96 gram of carbon black (Black Pearls 2000) for 2 minutes with the blending impeller operating at 3,500 RPM, and then with 3.6 grams of zinc stearate for another 6 minutes at an impeller speed of 3,000 RPM. The latter blending was continued until the volume resistivity of toner was in the range of $5\times10^4$ to $5\times10^6$ ohm-cm. For this particular toner, the final volume resistivity was $2\times10^5$ ohm-cm. After dry blending, the toner was further sieved through a 63 micron sieve, and was ready for use. The toner prepared according to the above procedure was evaluated in a Delphax S6000 printer. The images developed were transfixed at 55° C. with a transfix pressure ranging from 1,500 psi to 4,000 psi. Print quality was evaluated from a checkerboard print pattern. The image optical density was measured using a standard integrating densitometer. Image fix was measured by the standardized tape pull method, and is expressed as a percentage of the retained image optical density after the tape test relative to the original image optical density. Image smearing was evaluated qualitatively by rubbing the fused checkerboard print using a blank paper under an applied force for a specific cycle time, and viewing the surface cleanliness of non-printed and printed areas of the page. Image ghosting was evaluated qualitatively for over 2,000 prints. For this toner, the image fix level was 93 percent, no image smear and no image ghosting were observed after 10,000 prints, and print quality was excellent.

EXAMPLE II

The preparation of a 16.4 micron diameter conductive black encapsulated toner with a crosslinked polysiloxane-incorporated poly(lauryl methacrylate) core binder is illustrated in the following example.

A mixture of 11 grams of lauryl methacrylate, 4 grams of dimethylsiloxane-(methacryloxypropyl)methylsiloxane copolymer having a viscosity of about 1,000 to 2,000 centistokes (polysiloxane (III)) with a (methacryloxypropyl)methylsiloxane mole percent of 2 to 3, 2.85 grams each of 2,2'-azobis(isobutyronitrile) and 2.85 grams of 2,2'-azobis(2,4-dimethylvaleronitrile), and 47.1 grams of Isonate 143 L was mixed by high shear blending using a Brinkmann polytron equipped with a PT 35/4 probe at 4,000 RPM for 30 seconds. To the resulting clear organic mixture was added 300 grams of Bayer magnetite Bayferrox 8610, and the mixture was homogenized for 3 minutes at 8,000 RPM using the same Brinkmann probe. One (1) liter of 0.12 percent (by weight) aqueous poly(vinyl alcohol) was added, and the mixture was homogenized at 9,000 RPM for 2 minutes using an IKA polytron equipped with a T45/4G probe. To the resulting suspension was added a solution of 37 milliliters of 1,4-bis(3-aminopropyl)piperazine in 80 milliliters of water, and the mixture was transferred to a 3-liter reaction kettle equipped with a mechanical stirrer and a temperature probe. The mixture was stirred at room temperature for 1 hour, and was subsequently heated in an oil bath over a period of 1 hour to a final reaction temperature of 85° C. Heating was continued at this temperature for an additional 6 hours. The reaction mixture was then worked up according to the procedure of Example I except that 25 grams instead of 23.5 grams of Aquadag E was employed during the spray drying stage. There were obtained 390 grams of dry toner product, and the volume average particle diameter of the toner was 16.4 microns with a volume average particle size dispersity of 1.30. The toner was then dry blended to yield a final volume resistivity of $4\times10^5$ ohm-cm, and this toner was then evaluated in a Delphax S6000 printer. The toner exhibited a fix level of 93 percent, no image smear, no image ghosting, and no toner agglomeration on standing or in the development housing of the printer.

EXAMPLE III

A 14.2 micron diameter conductive black encapsulated toner with a polysiloxane-incorporated poly(lauryl methacrylate) core binder is prepared by the following procedure.

The toner was prepared in accordance with the procedure of Example I except that 15 grams of monomethacryloxypropyl terminated polydimethylsiloxane (polysiloxane (II)) was employed instead of polysiloxane (I). In addition, 1 liter of 0.21 percent (by weight) of an aqueous solution of poly(vinyl alcohol) instead of 0.18 percent poly(vinyl alcohol) solution was selected. Three hundred and fifty (350) grams of dry toner were obtained, and the toner's volume average particle diameter was 14.2 microns with a volume average particle size dispersity of 1.34. This toner was machine tested in a Delphax S6000 printer according to the procedure of Example I, and substantially similar results were obtained.

EXAMPLE IV

An 18.3 micron diameter conductive black encapsulated toner comprising a crosslinked polysiloxane-incorporated poly(lauryl methacrylate-stearyl methacrylate) ternary core binder was prepared as follows.

The toner was prepared in accordance with the procedure of Example I except that 60 grams each of lauryl methacrylate and stearyl methacrylate were utilized in place of 120 grams of lauryl methacrylate. In addition, 280 grams of Magnox magnetite TMB-100 was employed instead of Northern Pigments magnetite NP-608, and the concentration of poly(vinyl alcohol) was 0.14 percent. A total of 370 grams of dry toner product was obtained. The volume average particle diameter was 18.3 with a volume average particle size dispersity of 1.25. This toner was evaluated in a Xerox 4060 TM printer according to the procedure of Example I and substantially similar results were obtained.

EXAMPLE V

The following example illustrates the preparation of a 13.1 micron conductive black toner comprising a crosslinked polysiloxane-incorporated poly(lauryl methacrylate-n-butyl methacrylate) ternary core binder.

A toner was prepared in accordance with the procedure of Example I with 15 grams of polysiloxane (II), 105 grams of lauryl methacrylate and 15 grams of n-butyl methacrylate in place of 13.0 grams of polysiloxane and 120 grams of lauryl methacrylate. In addition, Northern Pigments magnetite NP-604 and 0.25 percent aqueous poly(vinyl alcohol) solution were utilized in place of, respectively, NP-608 and 0.18 percent aqueous poly(vinyl alcohol) solution. The preparation of this toner was also accomplished without 20 milliliters of dichloromethane. There was obtained 347 grams of dry toner with a volume average particle diameter of 13.1 and a volume average particle size dispersity of 1.35. This toner was machine tested in a Delphax S6000 printer, and substantially similar results were obtained as reported in Example I.

EXAMPLE VI

The following example illustrated the preparation of a 11.9 micron insulating black encapsulated toner comprising a crosslinked polysiloxane-incorporated poly(lauryl methacrylate-n-butyl methacrylate) ternary core binder.

The toner was prepared in accordance with the procedure of Example I with 15 grams of polysiloxane (I), 150 grams of lauryl methacrylate, 50 grams of n-butyl methacrylate, and 4.0 grams each of 2,2'-azobis-(2,4-dimethylvaleronitrile) and 2,2'-azobis-(isobutyronitrile) in place of 13.0 grams of polysiloxane (I), 120 grams of lauryl methacrylate and 3.30 grams each of 2,2'-azobis-(2,4-dimethylvaleronitrile) and 2,2'-azobis-(isobutyronitrile). In addition, 200 grams of Magnox magnetite TMB-100 and 0.15 percent aqueous poly(vinyl alcohol) solution were employed instead of, respectively, 280 grams of Northern Pigments magnetite NP-608 and 0.18 percent aqueous poly(vinyl alcohol) solution. Furthermore, to render the toner insulating, the wet toner was spray dried without Aquadag E, and dry blended with zinc stearate without the carbon black. There was obtained 340 grams of dry toner with a volume average particle diameter of 11.9 and a volume average particle size dispersity of 1.37. This toner was machine tested in a xerographic imaging test fixture similar to the Xerox Corporation 1065 TM that generated electrostatic latent images, and the images were subsequently pressure fixed with a suitable pressure roll at 2,000 psi. The image fix level was 91 percent, with clean image background, and no offset to the pressure roll.

EXAMPLE VII

A 14.7 micron diameter blue encapsulated toner comprising a crosslinked polysiloxane-incorporated poly(lauryl methacrylate-n-butyl methacrylate) core binder was prepared as follows.

The toner was prepared in accordance with the procedure of Example VI with 210 grams of lauryl methacrylate instead of 150 grams of lauryl methacrylate. In addition, 125 grams of Degussa Aerosil and 20 grams of copper phthalocyanine were utilized in place of 200 grams of Magnox magnetite TMB-100. Furthermore, the wet toner was spray dried without Aquadag E, and dry blended with zinc stearate without the carbon black. There were obtained 364 grams of dry toner with a volume average particle diameter of 14.7 and a volume average particle size dispersity of 1.39. The toner was machine tested in an experimental xerographic copier/printer by repeating the procedure of Example VI, and substantially similar results were obtained.

EXAMPLE VIII

A 22.7 micron (refers to average diameter in microns throughout) conductive black encapsulated toner with a polysiloxane-incorporated poly(lauryl methacrylate) ternary core binder was prepared by the following procedure.

The toner was prepared in accordance with the procedure of Example I except that 6 grams each of polysiloxanes (I) and (II), and Columbian magnetite Mapico Black were employed instead of polysiloxane (I) and Northern Pigments magnetite NP-608. In addition, 1 liter of 0.13 percent (by weight) of an aqueous solution of poly(vinyl alcohol) instead of 0.18 percent poly(vinyl alcohol) solution was selected. There were obtained 362 grams of dry toner, and the toner's volume average particle diameter was 22.7 microns with a volume average particle size dispersity of 1.33. Evaluation of this toner was conducted in a Delphax S6000 printer according to the procedure of Example I, and substantially similar results were obtained.

EXAMPLE IX

A 15.3 micron diameter conductive black encapsulated toner with a polysiloxane-incorporated poly(lauryl methacrylate) core binder was prepared by the following procedure.

The toner was prepared in accordance with the procedure of Example I except that 6 grams of polysiloxane (I) and 2.0 grams of polysiloxane (III), and Pfizer magnetite MCX 6368 were employed instead of polysiloxane (I) and Northern Pigments magnetite NP-608. In addition, 1 liter of 0.20 percent (by weight) of an aqueous solution of poly(vinyl alcohol) instead of 0.18 percent poly(vinyl alcohol) solution was selected. There were obtained 371 grams of dry toner, and the toner's volume average particle diameter was 15.3 microns with a volume average particle size dispersity of 1.29. Evaluation of this toner was conducted in a Delphax S6000 printer according to the procedure of Example I, and substantially similar results were obtained.

EXAMPLE X

A 12.7 micron diameter conductive black microcapsule toner with a polysiloxane-incorporated poly(lauryl methacrylate-n-hexyl methacrylate) ternary core binder was prepared by the following procedure.

The toner was prepared in accordance with the procedure of Example I except that 100 grams of lauryl methacrylate, 20 grams of hexyl methacrylate, and Pfizer magnetite MCX 6368 were employed instead of 120 grams of lauryl methacrylate and Northern Pigments magnetite NP-608. In addition, 1 liter of 0.22 percent (by weight) of an aqueous solution of poly(vinyl alcohol) instead of 0.18 percent poly(vinyl alcohol) solution was selected. There were obtained 358 grams of dry toner, and the toner's volume average particle diameter was 12.7 microns with a volume average particle size dispersity of 1.36. Evaluation of this toner was conducted in a Delphax S6000 printer according to the procedure of Example I, and substantially similar results were obtained.

Other modifications of the present invention may occur to those skilled in the art based subsequent to a review of the present application, and these modifications, including equivalents thereof are intended to be included within the scope of the present invention.

What is claimed is:

1. An encapsulated toner composition comprised of a core comprised of pigments or dyes and a polysiloxane incorporated core binder resin, which core is encapsulated in a shell and wherein the polysiloxane-incorporated core binder resin is comprised of a copolymer derived from functionalized polysiloxanes capable of undergoing addition polymerization, and a monomer; and wherein the shell is selected from the group consisting of polyurea, polyamide, polyester, polyurethane and mixtures thereof.

2. A toner in accordance with claim 1 wherein the polysiloxane-incorporated binder resin is derived from the copolymerization of an addition-type monomer selected form the group consisting of propyl acrylate, propyl methacrylate, butyl acrylate, butyl methacrylate, pentyl acrylate, pentyl methacrylate, hexyl acrylate, hexyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, heptyl acrylate, heptyl methacrylate, isobutyl acrylate, isobutyl methacrylate, methylbutyl acrylate, methylbutyl methacrylate, tolyl acrylate, tolyl methacrylate, styrene, dodecyl styrene, hexyl methyl styrene, nonyl styrene, or tetradecyl styrene, and a functionalized polysiloxane.

3. A toner in accordance with claim 1 wherein the polysiloxane is represented by Formulas I, II, III, IV, V, or VI, wherein R′ is alkylene, arylene, or the substituted derivatives thereof; R, R″ and R‴ are independently selected from the group consisting of alkyl and substituted alkyl; n represents the number of segments; and y and z are mole fraction numbers wherein y is greater than 0, and the sum of $x+y$ is equal to 1.

4. A toner in accordance with claim 1 wherein the core binder is a copolymer derived from the copolymerization of an acryloxy-, a methacryloxy-, or a styryl-functionalized polysiloxane and an acrylate, a methacrylate, or a styryl monomer.

5. A toner in accordance with claim 1 wherein the core binder resin is comprised of a copolymer of acryloxy- or methacryloxy-functionalized polysiloxane and alkyl acrylate or alkyl methacrylate.

6. A toner in accordance with claim 1 wherein the core binder resin is comprised of a crosslinked copolymer of acryloxy- or methacryloxy-functionalized polysiloxane and alkyl acrylate or alkyl methacrylate.

7. A toner in accordance with claim 6 wherein the alkyl group contains from about 1 to about 30 carbon atoms, and preferably from about 3 to about 18 carbon atoms.

8. A toner in accordance with claim 1 wherein the core binder resin is comprised of a copolymer of styryl-functionalized polysiloxane and an addition monomer.

9. A toner in accordance with claim 1 wherein the functionalized polysiloxane is selected from the group consisting of a mono(acryloxyalkyl)-functionalized polydialkylsiloxane, a mono(methacryloxyalkyl)-functionalized polydialkylsiloxane, a bis(acryloxyalkyl)-functionalized polydialkylsiloxane, a bis(methacryloxy)-functionalized polydialkylsiloxane, a poly(acryloxy)-functionalized and a poly(methacryloxy)-functionalized dialkylsiloxane polymer.

10. A toner in accordance with claim 9 wherein the functionalized polysiloxane is selected from the group consisting of mono(acryloxyalkyl)-functionalized polydimethylsiloxane, a mono(methacryloxyalkyl)-functionalized polydimethylsiloxane, a bis(acryloxyalkyl)-functionalized polydimethylsiloxane, a bis(methacryloxy)-functionalized polydimethylsiloxane, a poly(acryloxy)-functionalized and a poly(methacryloxy)-functionalized polydimethylsiloxane polymer.

11. A toner in accordance with claim 1 wherein the functionalized polysiloxane has a molecular weight of from about 500 to about 60,000.

12. A toner in accordance with claim 1 wherein the functionalized polysiloxane has a molecular weight of from about 5,000 to about 35,000.

13. A toner in accordance with claim 1 wherein the pigment is carbon black, iron oxides, magnetites, or mixtures thereof.

14. A toner in accordance with claim 13 wherein the magnetite is selected from the group consisting of Mapico Blacks and surface treated magnetites.

15. A toner in accordance with claim 1 wherein the pigment is selected from the group consisting of cyan, yellow, magent, red, green, blue, brown, and mixtures thereof.

16. A toner in accordance with claim 15 wherein the pigment is selected from the group consisting of Heliogen Blue L6900, D6840, D7080, D7020, Pylam Oil Blue, Pylam Oil Yellow, Pigment Blue 1, Pigment Violet 1, Pigment Red 48, Lemon Chrome Yellow DCC 1026, E.D. Toluidine Red, Bon Red C, NOVAperm Yellow FGL, Hostaperm Pink E, Cinquasia Magenta, Oil Red 2144, 2,9-dimethyl-substituted quinacridone and anthraquinone dye, CI Dispersed Red 15, diazo dye, CI Solvent Red 19, copper tetra-4(octadecyl sulfonamido) phthalocyanine, X-copper phthalocyanine pigment, CI Pigment Blue, Anthrathrene Blue, Special Blue X-2137, diarylide yellow 3,3- dichlorobenzidene acetoacetanilides, a monoazo pigment, CI Solvent Yellow 16, a nitrophenyl amine sulfonamide, CI Dispersed Yellow 33, 2,5-dimethoxy-4-sulfonanilide phenylazo-4′-chloro-2,5-dimethoxy acetoacetanilide, and Permanent Yellow FGL.

17. A toner in accordance with claim 1 wherein the shell represents from about 5 to about 30 percent by weight of toner, the core binder resin represents from about 20 to about 90 percent by weight of the toner, and the pigment or dye represent from about 2 to about 65 percent by weight of the toner.

18. A toner in accordance with claim 1 wherein the average toner shape is spherical, and the average toner particle diameter is from about 5 to about 25 microns.

19. A toner in accordance with claim 1 containing surface additives.

20. A toner in accordance with claim 19 wherein the surface additives are metal salts, metal salts of fatty acids or colloidal silicas.

21. A toner in accordance with claim 19 wherein a zinc stearate additive is selected.

22. A toner in accordance with claim 19 wherein the additives are present in an amount of from about 0.1 to about 5.0 weight percent.

23. A toner in accordance with claim 1 wherein the toner shell is prepared by interfacial polymerization.

24. A toner in accordance with claim 1 wherein the shell surface contains conductive components.

25. A toner in accordance with claim 24 wherein the conductive components are comprised of carbon blacks, graphite, or mixtures thereof.

26. A toner in accordance with claim 1 wherein the core binder resin is obtained by free radical polymerization of a functionalized polysiloxane or polysiloxanes, and an addition monomer or monomers.

27. A toner in accordance with claim 1 wherein the core binder resin contains a crosslinked polysiloxane-incorporated addition polymer.

28. A toner in accordance with claim 1 wherein mixtures of dyes and pigments are selected.

29. A toner in accordance with claim 1 wherein mixtures of dyes and pigments are selected.

30. An encapsulated toner composition comprised of a core comprised of a polysiloxane-incorporated polymer resin, colorants, and a shell thereover wherein the polysiloxane-incorporated core binder resin is comprised of a copolymer of functionalized polysiloxanes capable of undergoing addition polymerization, and a monomer.

31. A toner in accordance with claim 30 wherein the polymer resin is comprised of a crosslinked copolymer of a functionalized polysiloxane and an acrylate, methacrylate, or styryl-functionalized monomer or monomers.

32. A toner in accordance with claim 31 wherein the functionalized polysiloxane is acryloxy-, methacryloxy-functionalized polydimethylsiloxane, or styryl-functionalized polydimethylsiloxane.

33. A toner in accordance with claim 30 wherein the colorant is carbon black, magnetites, or mixtures thereof.

34. A toner in accordance with claim 30 wherein the colorant present in the core is black, cyan, magenta, yellow, red, blue, green, brown, or mixtures thereof.

35. A toner in accordance with claim 30 wherein the core monomer or monomers for the core polymer are selected from the group consisting of alkyl acrylates, alkyl methacrylates, styrene and styrene derivatives.

36. A toner in accordance with claim 30 wherein the core is a binder resin of a copolymer of a functionalized polysiloxane and a core monomer selected from the group consisting of n-butyl acrylate, s-butyl acrylate, isobutyl acrylate, n-butyl methacrylate, s-butyl methacrylate, isobutyl methacrylate, benzyl acrylate, benzyl methacrylate, propyl acrylate, isopropyl acrylate, hexyl acrylate, cyclohexyl acrylate, hexyl methacrylate, cyclohexyl methacrylate, lauryl acrylate, lauryl methacrylate, pentyl acrylate, pentyl methacrylate, stearyl acrylate, stearyl methacrylate, ethoxypropyl acrylate, ethoxypropyl methacrylate, heptyl acrylate, heptyl methacrylate, methylbutyl acrylate, methylbutyl methacrylate, m-tolyl acrylate, dodecyl styrene, hexylmethyl styrene, nonyl styrene, and tetradecyl styrene.

37. A toner in accordance with claim 30 wherein a polymeric shell is selected.

38. A toner in accordance with claim 30 wherein the shell is a crosslinked or an uncrosslinked polyurea, polyester, polyurethane, polyamide polymer, or mixtures thereof.

39. A toner in accordance with claim 30 wherein the polysiloxane is represented by the Formulas I, II, III, IV, V, or VI, wherein R′ is alkylene, arylene, or the substituted derivatives thereof; R, R″ and R‴ are independently selected from the group consisting of alkyl and substituted alkyl; n represents the number of segments; and y and z are mole fraction numbers wherein y is greater than 0, and the sum of $x+y$ is equal to 1.

40. A toner in accordance with claim 39 wherein the polysiloxane contains at least one addition type functionality.

41. An encapsulated toner comprised of a core comprised of a pigment and a polysiloxane incorporated core binder resin, and wherein the aforementioned core is encapsulated within a polymeric shell wherein the polysiloxane-incorporated core binder resin is comprised of a copolymer of a functionalized polysiloxane capable of undergoing addition polymerization, and a monomer.

42. An encapsulated toner composition comprised of a core comprised of pigment, a core resin binder comprised of a copolymer of a functionalized polysiloxane capable of undergoing addition polymerization, and a monomer; and wherein the aforementioned core components are encapsulated within a polymeric shell wherein the polysiloxane-incorporated core binder resin is comprised of a copolymer of functionalized polysiloxanes capable of undergoing addition polymerization, and a monomer.

* * * * *